US006155032A

United States Patent [19]

Lai

[11] Patent Number: 6,155,032

[45] Date of Patent: Dec. 5, 2000

[54] AUTOMATIC WRAPPER

[76] Inventor: Chien-Fa Lai, No. 56, Industry 35 Rd., Hsi-Tun Dist., Taichung, Taiwan

[21] Appl. No.: 09/391,983

[22] Filed: Sep. 9, 1999

[51] Int. Cl.[7] ..... B65B 13/04

[52] U.S. Cl. ..... 53/589; 100/29; 100/32

[58] Field of Search ..... 53/589; 100/29, 100/32

[56] References Cited

U.S. PATENT DOCUMENTS

| | | | |
|---|---|---|---|
| 3,866,812 | 2/1975 | Gutjahr | 226/50 |
| 4,995,776 | 2/1991 | Kato | 53/589 |
| 5,155,982 | 10/1992 | Boek et al. | 53/589 |
| 5,377,477 | 1/1995 | Haberstroh et al. | 53/589 |
| 5,509,594 | 4/1996 | Maggioni | 100/32 |
| 5,640,899 | 6/1997 | Bell et al. | 100/2 |

*Primary Examiner*—Peter Vo
*Assistant Examiner*—Hemant M. Desai
*Attorney, Agent, or Firm*—Wolf, Greenfield & Sacks, P.C.; James H. Morris

[57] ABSTRACT

An automatic wrapper includes a roll of tape to wrap a package tightly and a tape operating device having a main arm attached thereto. A groove is defined in the main arm to receive a tape roller which is pivotally mounted in the groove. An L-shaped connecting plate is attached to the tape operating device. A motor is attached to the wrapper to supply the power for the tape operating device. The motor includes a support that has two side arm extending therefrom to abut the main arm. The main arm is pivotally mounted on the side arms by an axle extending through the side arms and the main arm. The motor includes a welding device and a cutting device each mounted on the support and a transmission device with an axle extending therefrom and received in the tape operating device. An electromagnet includes an actuating rod attached thereto, a linkage attached to the actuating rod, an active rod connecting the tape operating device, a cam and a lever each attached to the support.

9 Claims, 7 Drawing Sheets

AUTOMATIC WRAPPER

BACKGROUND OF THE INVENTION

1. Field of The Invention

The present invention relates to a wrapper, and more particularly to an automatic wrapper that can wrap a package easily and tightly.

2. Description of Related Art

A conventional wrapper in accordance with the prior art shown in FIG. 5 and FIG. 6 comprises a thermal welding and cutting device (90), a tape operating device (60) attached to the thermal welding and cutting device (90) to control the feeding and reversing of the tape (80) and an electromagnet (70) mounted on the tape operating device (60) to control the tape operating device (60).

The tape operating device (60) includes a base member (600) that has a feed roller (61) and a reverse roller (62) each pivotally mounted thereon. A support (63) has a tape roller (632) pivotally mounted on a first end and a second end fastened to the thermal welding and cutting device (90). A pair of brackets (631) extend from the support (63) to pivotally attach to the tape operating device (60) between the feed roller (61) and the reverse roller (62) to allow the base member (600) of the tape operating device (60) to pivot on the support (63).

The electromagnet (70) includes a Z-shaped plate (72) which has a first end penetrated by an actuating rod (71) and a roller (751) pivotally mounted on the second end. A spring (711) is mounted around the end of the actuating rod (71) that extends through the Z-shaped plate (72) and is held in place by a nut. The electromagnet (70) is enclosed by a case with an L-shaped connecting plate (731) is welded to the case. An auxiliary rod (73) is attached to the connecting plate (731) with a first spring (733) mounted around the auxiliary rod (73) and abutting the connecting plate (731). The auxiliary rod (73) extends through the Z-shaped plate (72) and compresses the first spring (733) between the Z-shaped plate (72) and the connecting plate (731). A second spring (734) is mounted around the end of the auxiliary rod (73) that extends through the Z-shaped plate (72) and is held in place by a nut. An active rod (74) has a third spring (742) mounted around a first end attached to the Z-shaped plate (72)and an adjusting knob (741) that is held in place by a nut. The active rod (74) has a second end attached to the base member (600) of the tape operating device (60). A roller (751) is attached to the second end of the Z-shaped plate (72) and rides on a cam (75) driven by a motor (not shown).

To operate the wrapper, referring to FIG. 7 the active rod (74) of the electromagnet (70) pulls the base member (600) to make a gap between the reverse roller (62) and the support (63) and to allow the tape (80) to pass therefrom. Then the tape (80) is pulled to a certain length due to the rolling of the feed roller (61). The operator pulls the free end of the tape (80) around the package (81) and inserts the tape (80) into the thermal welding and cutting device (90) it touches the sensor (91).

Referring to FIGS. 6 and 8, the cam (75) pushes the Z-shaped plate (72), and the active rod (74) raises the base member (600) up. Then the reverse roller (62) squeezes and reverses the tape (80) to ensure the package (81) is wrapped tightly. Then the thermal welding and cutting device (90) welds and cuts the tape (80).

No doubt the conventional wrapper can wrap the package, but the tape operating device (60) and the electromagnet (70) have several disadvantages.

1. The structure of the tape operating device (60) and the electromagnet (70) are very complicated. The tape operating device (60) must have a base member (600) with a feed roller (61) and a reverse roller (62) mounted thereon. An auxiliary rod (73) and a Z-shaped plate (72) are connected to the electromagnet (70). Furthermore ringed a first spring (733) and a second spring (734) must be around the auxiliary rod (73), a third spring (742) needs to be mounted around the active rod (74) that connects to the base member (600), and an adjustment knob (741) must be mounted on the active rod (74). The structure has so many parts and is so complicated that the cost of the wrapper is high.

2. The positions of feeding and reversing are not very stable. Whether the tape operating device (60) is feeding tape (80) or reversing tape (80) depends on the lever motion of the base member (600) to make the feed roller (61) and the reverse roller (62) squeeze or release the tape (80). Consequently, the Z-shaped plate (72) is always moving up and down. To keep the tape operating device (60) in position to reverse the tape (80) depends to the elasticity and strength of the first spring (733) and third spring (742). The mass of the base member (600) is large, so the load on the reversing tape (80) is very heavy. Wrapping the package (81) tightly or a very smooth tape (80) surface may cause the base member (600) use the pair of pivotal seat (631) as a fulcrum and swing back. Consequently, the wrapping is often not good because the reverse roller (62) releases the tape (80) when the load is heavy.

The present invention has arisen to mitigate and/or obviate the disadvantage of the conventional tape operating device of a wrapper.

SUMMARY OF THE INVENTION

In accordance with one aspect of the present invention, a tape operating device is provided. The structure of the tape operating device is simple and can provide a steady effect of reversing tape and binding tightly to a package.

Further benefits and advantages of the present invention will become apparent after a careful reading of the detailed description with appropriate reference to the accompanying drawings.

DETAILED DESCRIPTION OF THE INVENTION

Figure 1:
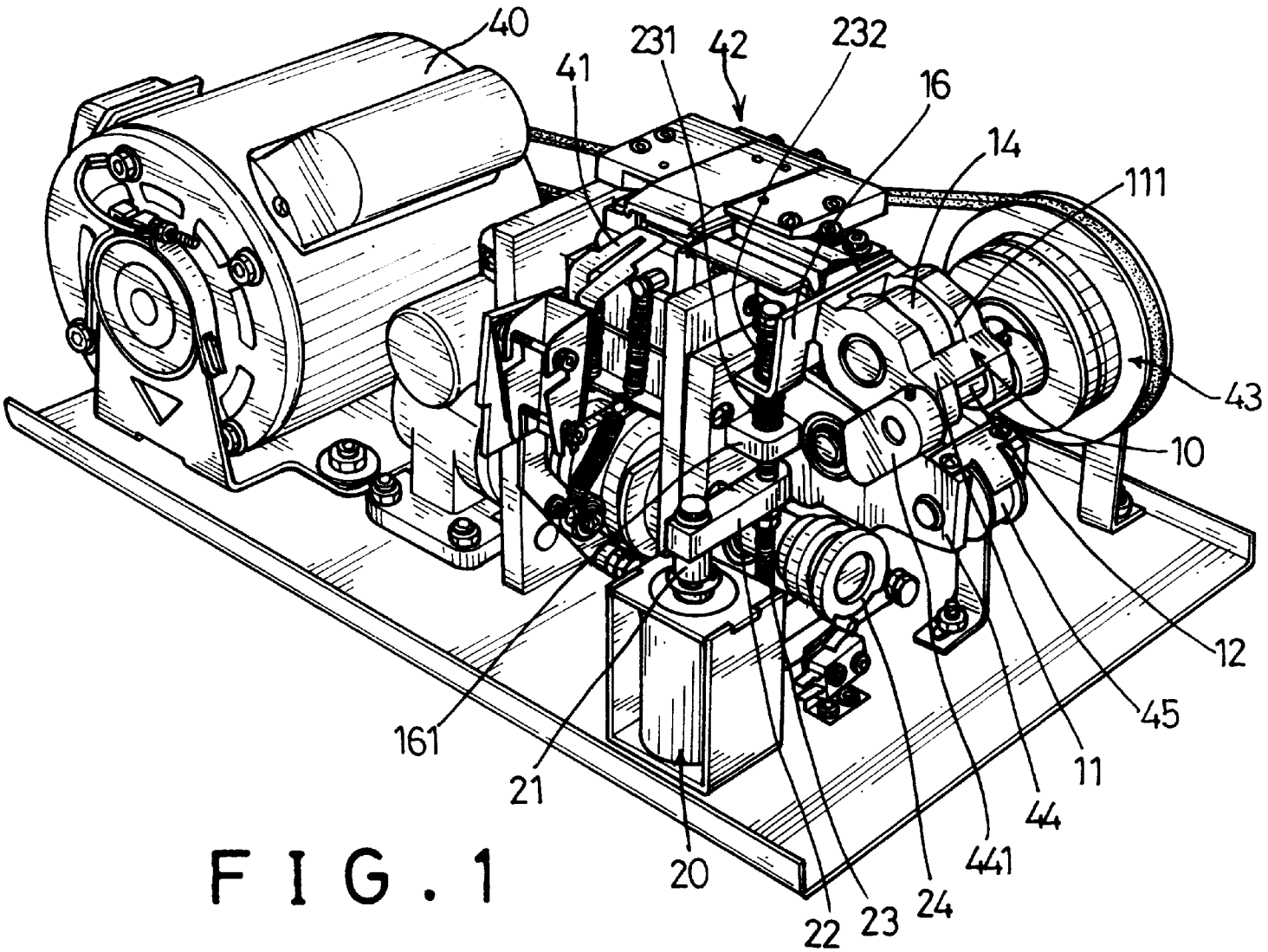
FIG. 1 is a perspective view of a wrapper in accordance with the present invention.

Referring to the drawings and initially to FIG. 1, a wrapper in accordance with the present invention comprises a tape operating device (10), a welding device (41) and a cutting device (42).

A pair of supports (44) extends from the cutting device (42) and a roller (45) is pivotally mounted on the end. A side arm (441) extends from each support (44) to abut the two sides of a main arm (11). A groove (111) is defined in the main arm (11), and a tape roller (14) is mounted in the groove (111). An axle (12) penetrates one end of the main arm (11) on which the side arms (441) are pivotally mounted. An L-shaped connecting plate (16) extends from the other end of the main arm (11) and aligns with a partition (161) that extends from the cutting device (42). An active rod (23) penetrates the partition (161) and the connecting plate (16). The first spring (231) is around active rod (23) between the partition (161) and the horizontal portion of the connecting plate (16). The second spring (232) is around the active rod (23) above the horizontal portion of the connecting plate (16) and is held in place by a nut.

An electromagnet (20) includes a actuating rod (21) attached thereto and a linkage (22) with a hole defined in each end. One hole in the linkage (22) receives the actuating rod (21) with a check ring to hold the actuating rod (21) in place, and the other hole is penetrated by the active rod (23) that is held in place by a check nut.

Figure 2:
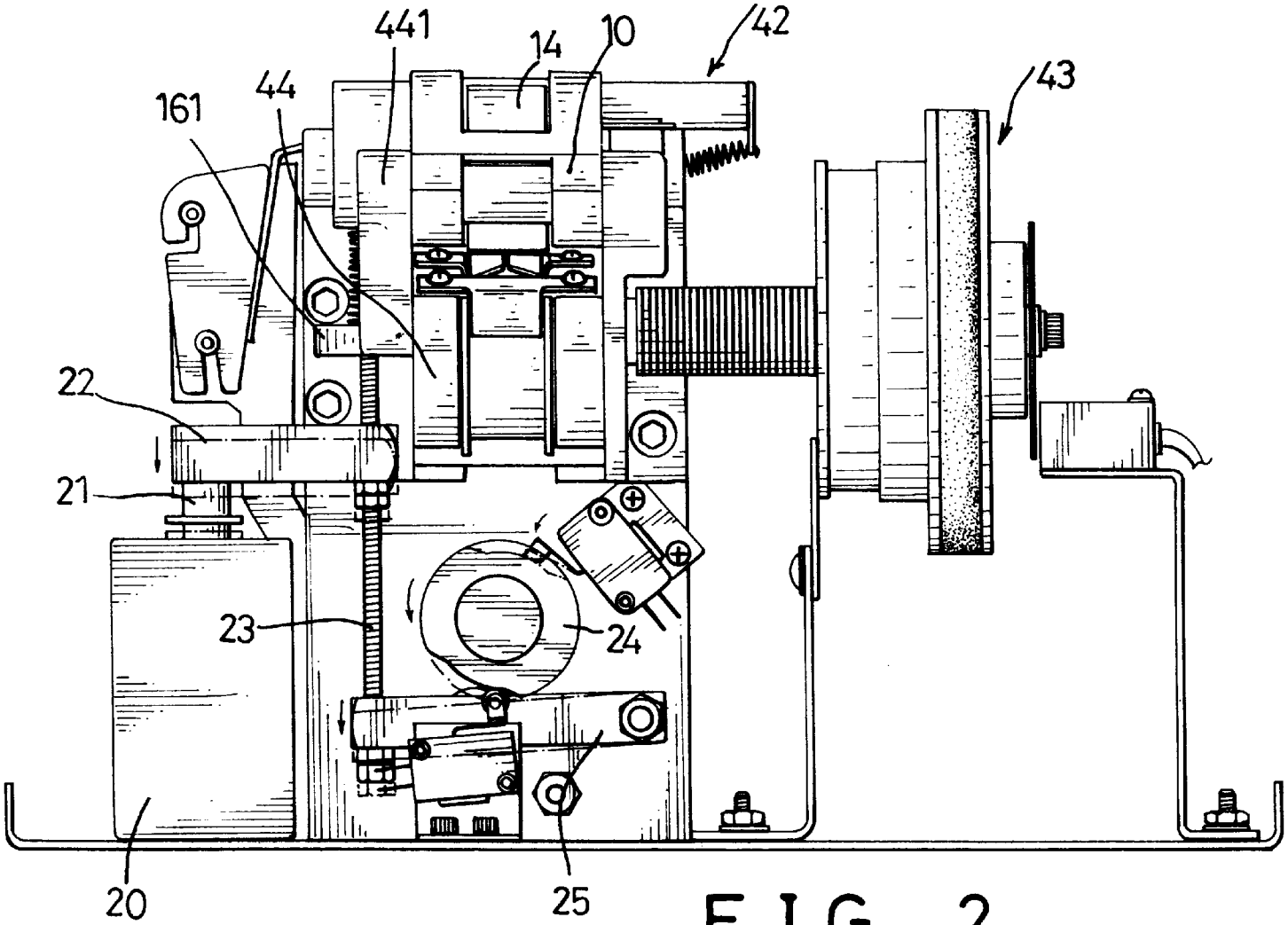
FIG. 2 is a right side plan view of the wrapper in FIG. 1.

Referring to FIG. 2, one end of a lever (25) is pivotally connected to the cutting device (42), and a bore is defined in the other end. The active rod (23) extends through the bore and is held in place by a check nut. A cam (24) is attached to the cutting device (42) and abuts the lever (25) to control the main arm (11) moving up or down.

Figure 3:
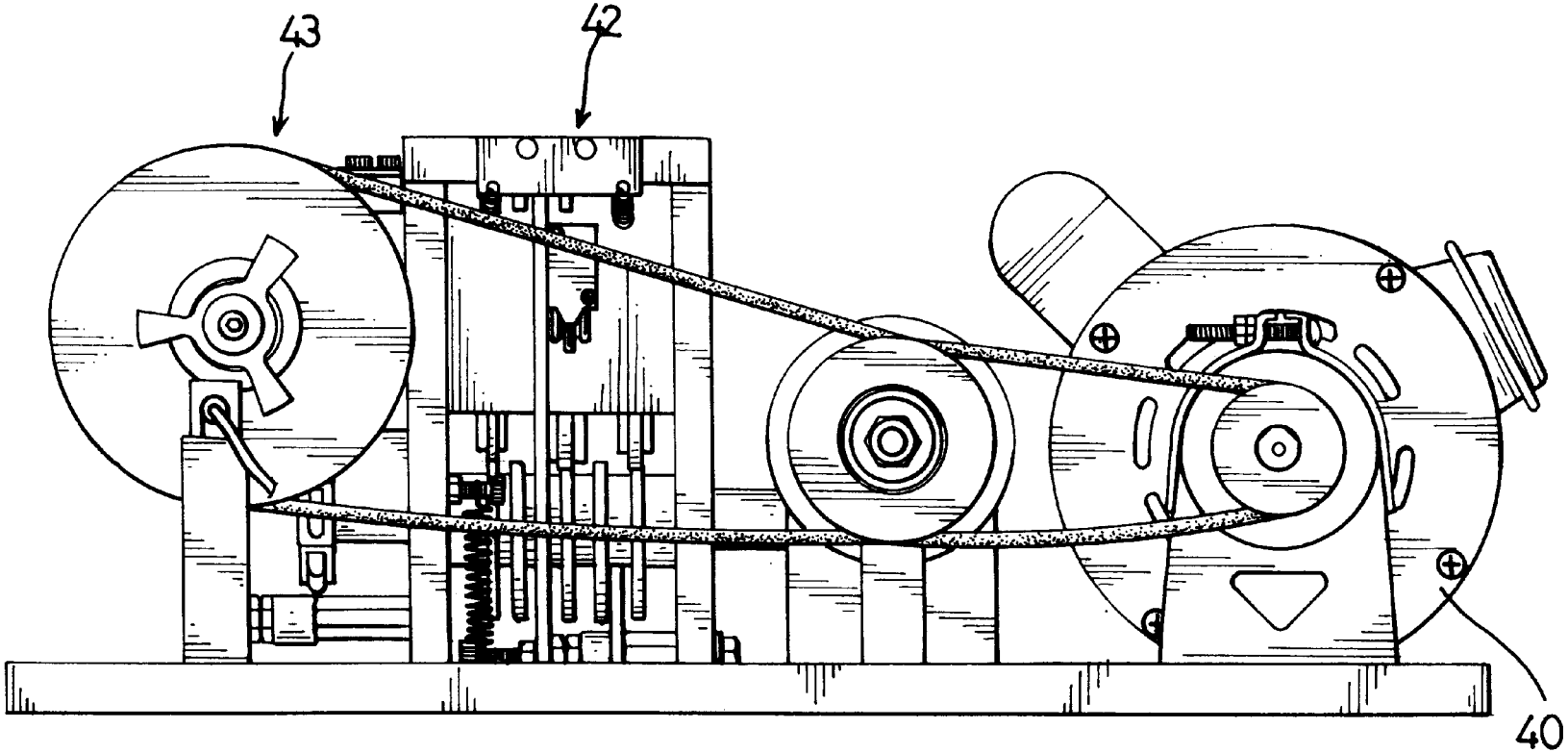
FIG. 3 is rear elevational view of the wrapper in FIG. 1.

Referring to FIGS. 1 and 3, the power source for the wrapper is a two-direction motor (40) that can turn in either the forward and reverse direction. The motor (40) transfers the power to the drive device (43) by belts and the belt rollers to control the tape's forward and reverse movement. Consequently the feeding and reversing of the tape operating device (10) is fundamentally different from the conventional wrapper. Using the motor (40) to directly feed and reverse the tape obviates the need to use a feed roller and a reverse roller.

Figure 4:
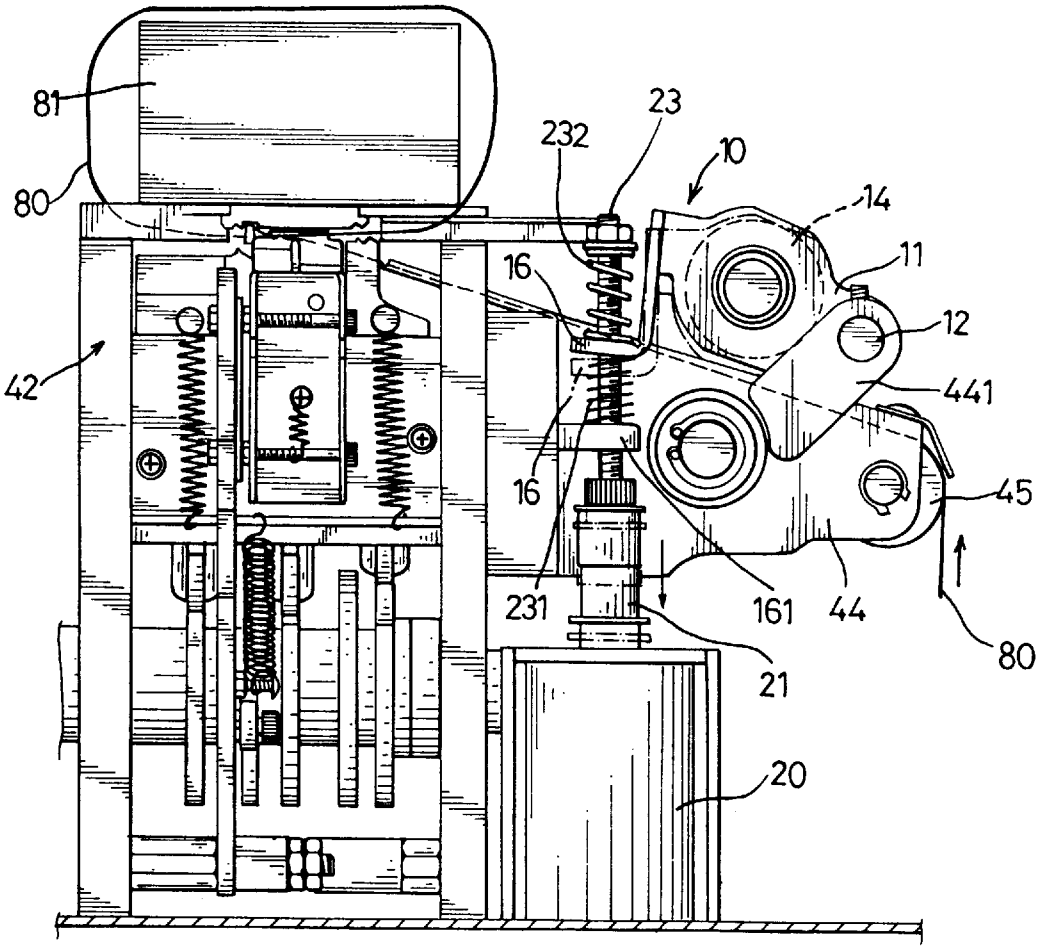
FIG. 4 is front elevational view of the tape operating device in FIG. 1.
Figure 5:
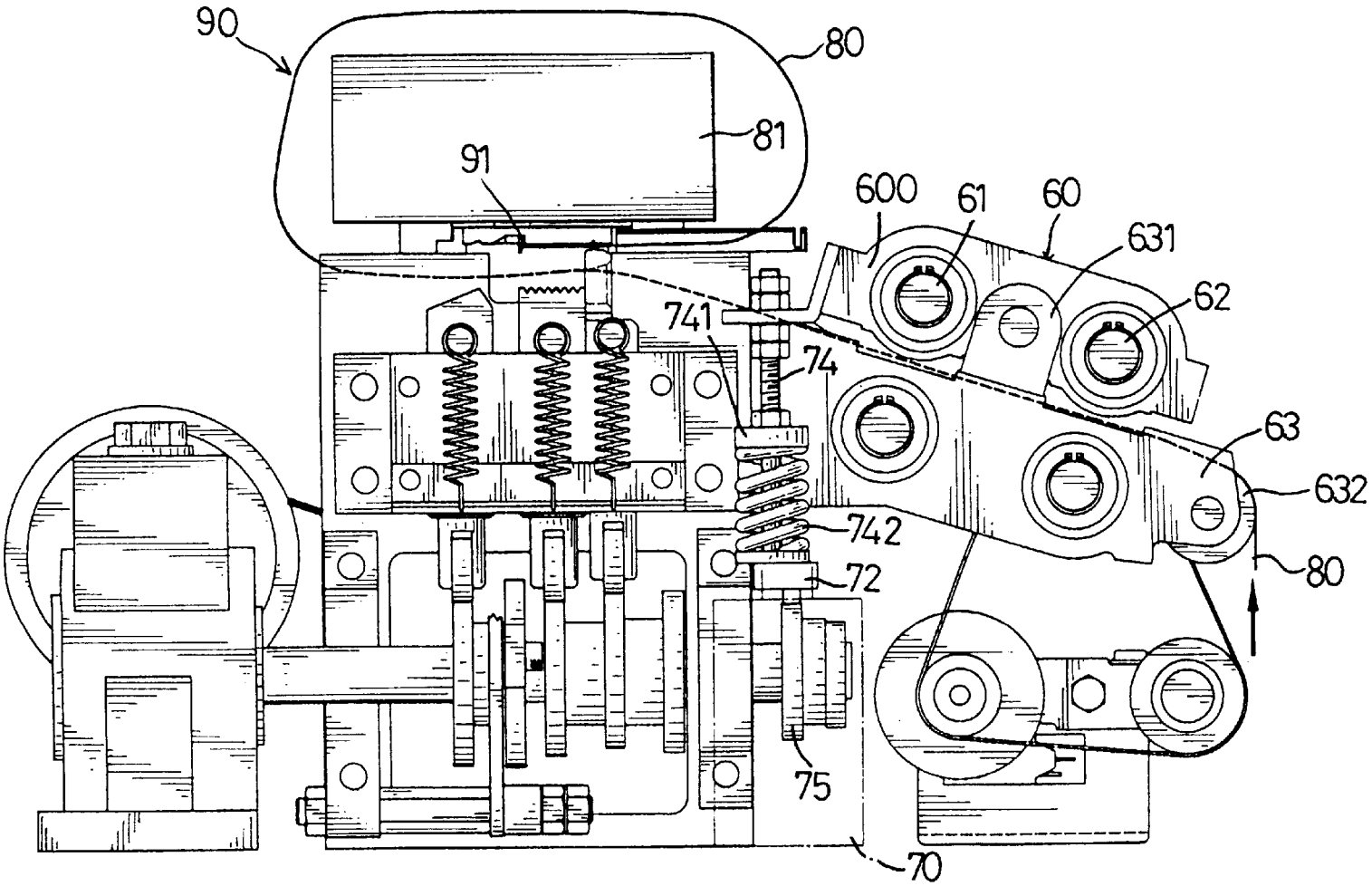
FIG. 5 PRIOR ART
FIG. 5 is a front elevational view of a conventional wrapper in accordance with the prior art.
Figure 6:
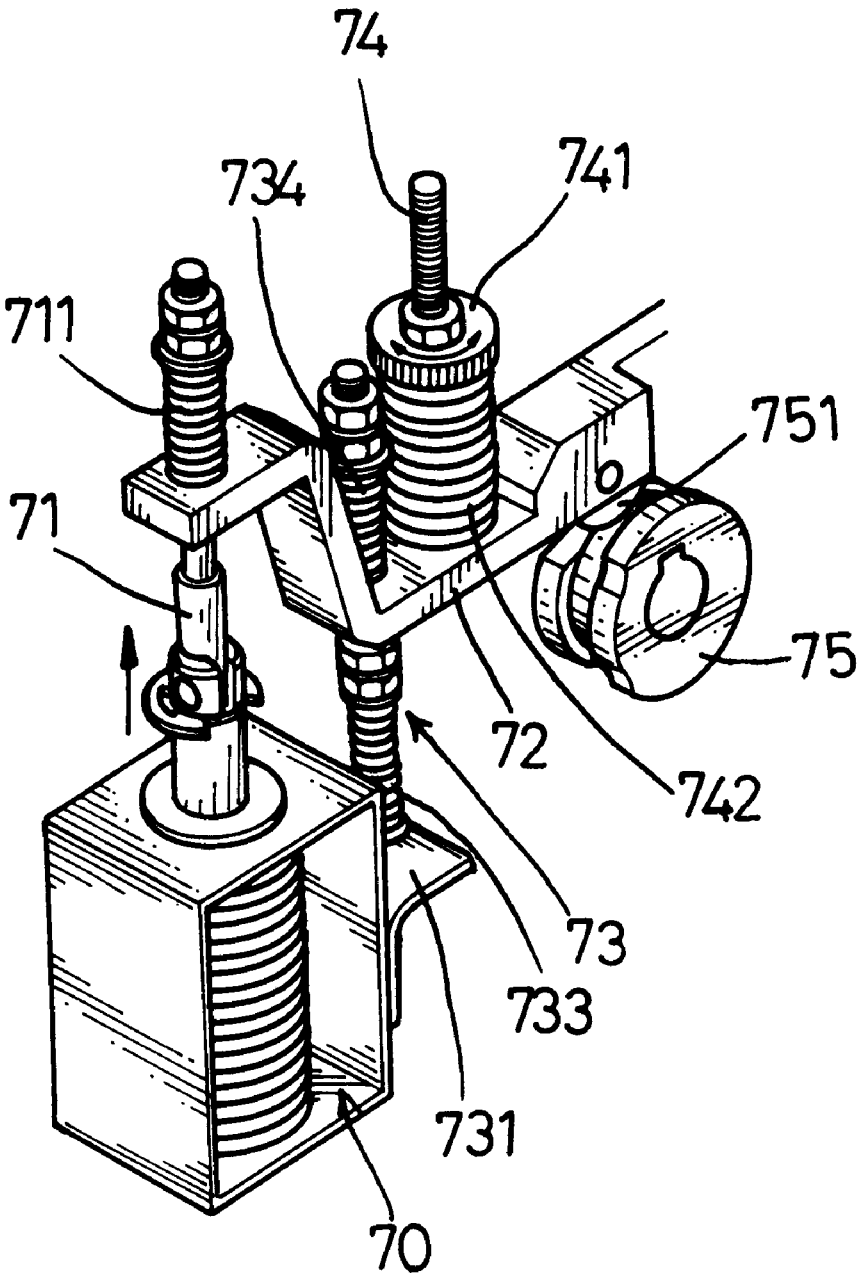
FIG. 6 PRIOR ART
FIG. 6 is a perspective view of the electromagnet and Z-shaped plate in FIG. 5.
Figure 7:
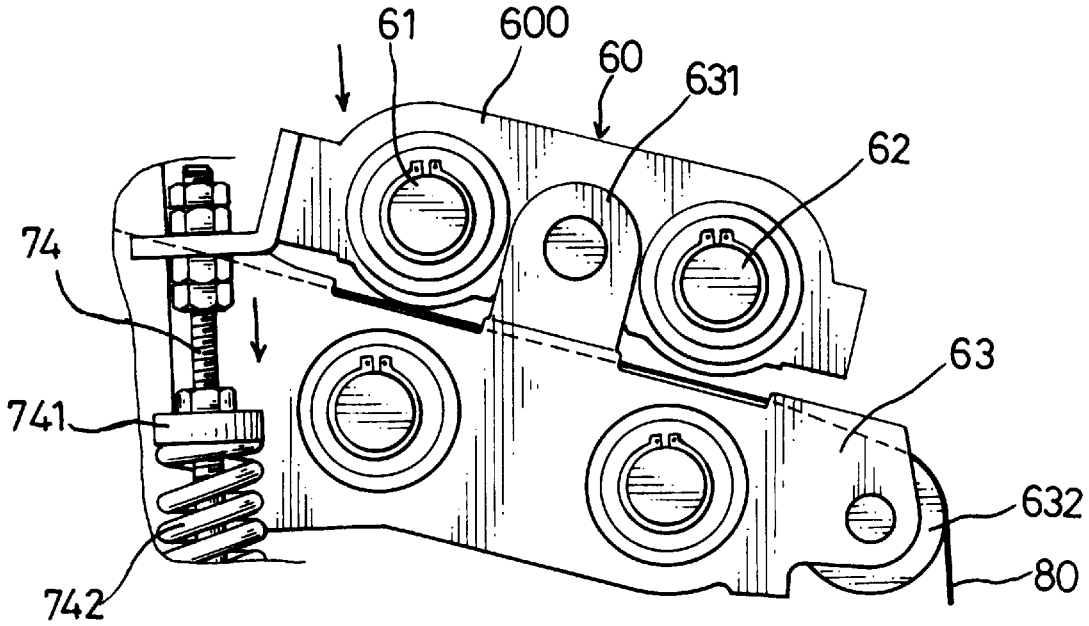
FIG. 7 PRIOR ART
FIG. 7 is an operational side plan view of the conventional tape operating device feeding tape.
Figure 8:
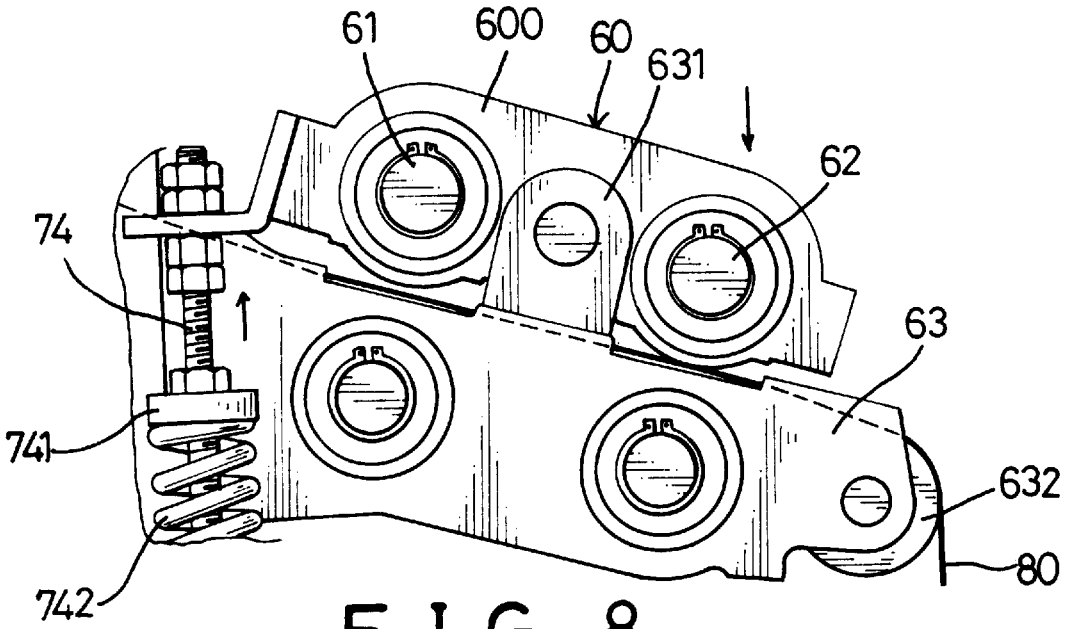
FIG. 8 PRIOR ART
FIG. 8 is an operational side plan view of the conventional tape operating device reversing tape.

Referring to FIG. 4, when feeding the tape (80), the direction of rotation of the tape roller (14) is controlled by the motor (40), and the electromagnet (20) actuating rod (21) pulls the connecting plate (16) to make the tape roller (14) touch the tape (80), then feed the tape (80) to the welding device (41) and the cutting device (42). Referring to FIGS. 2 and 4, when reversing the tape (80), the cam (24) is turned and uses the eccentric action of the cam (24) to cause the lever (25) to move down. Then the connecting plate (16) is pulled down to press the spring (231) by the active rod (23), and the main arm (11) uses the axle (12) as a fulcrum to move down. Using the reverse function of the motor (40), the tape roller (14) reverses the tape (80) and binds the package (81) tightly. When ending reversing situation, the main arm (11) uses the axle (12) as a fulcrum and is moved back to the original position by the restoring force of the spring (231). The cam (24) turns back to the original position because the active rod (23) moves back, too.

There are several advantages of the present invention as follows:

1. The structure is simple. The tape operating device (10) of the present invention only needs a main arm (11) and a tape roller (14). The linkage (22) connects to the actuating rod (21) of the electromagnet (20) and the active rod (23), the active rod (23) connects to the lever (25), and the main arm (11) only has two spring (231, 232). Consequently, the structure is much simpler than the conventional wrapper.

2. The technique of interfacing the main arm (11) and the tape roller (14) is changed. When the active rod (23) pulls down the main arm (11) to press the first spring (231) the direction of the force is in line with the force of gravity. Only one tape roller (14) is pivotally mounted on the main arm (11). Consequently the load on the actuating rod is light when pulling the main arm (11) down. Consequently, the tape operating device wraps a package tightly.

Although the invention has been explained in relation to its preferred embodiment, it is to be understood that many other possible modification and variation can be made without departing from the spirit and scope of the invention as hereinafter claimed.

What is claimed is:

1. An automatic wrapper comprising:

a roll of tape (80) to wrap a package tightly;

a tape operating device (10) including a main arm (11) attached thereto, a groove (111) defined in said main arm (11) to receive a tape roller (14) pivotally mounted in said groove (111) and a L-shaped connecting plate (16) attached to said tape operating device (10);

a motor (40) attached to the wrapper including a support (44) attached to said main arm (11), a welding device (41) and a cutting device (42) each mounted on said support (44) and a transmission device (43) having an axle extending therefrom and received in said tape operating device (10); and an electromagnet (20) including an actuating rod (21) attached thereto, a linkage (22) attached to said actuating rod (21), an active rod (23) connecting the tape operating device (10), a cam (24) and a lever (25) each attached to said support (44).

2. The automatic wrapper in accordance with claim 1, wherein said support (44) includes a roller (45) pivotally mounted thereon so as to abut said tape (80).

3. The automatic wrapper in accordance with claim 1, wherein said support (44) includes two side arms (441) each extending therefrom and a hole defined therein.

4. The automatic wrapper in accordance with claim 3, wherein said tape operating device (10) includes an axle (12) with an end received in each said hole of said side arms (441).

5. The automatic wrapper in accordance with claim 4, wherein said main arm (11) is pivotally mounted on said side arms (441) of said support (44) by said axle (12) extending through said main arm (11).

6. The automatic wrapper in accordance with claim 1, wherein said lever (25) includes a hole to allow said active rod (23) to extend therethrough and is held in place by a check nut.

7. The automatic wrapper in accordance with claim 1, wherein said cutting device (42) includes a partition (161) extending therefrom with a hole defined therein to receive said active rod (23).

8. The automatic wrapper in accordance with claim 1, wherein said active rod (23) is threaded.

9. The automatic wrapper in accordance with claim 7, wherein a first spring (231) and a second spring (232) are around said active rod (23), said first spring (231) being between said partition (161) and said connecting plate (16), said second spring abutting said connecting plate (16) and held in place by a check nut.

* * * * *